US006761291B2

(12) United States Patent
Moskovitz et al.

(10) Patent No.: US 6,761,291 B2
(45) Date of Patent: Jul. 13, 2004

(54) GARMENT STORAGE RECEPTACLE

(76) Inventors: Michelle Moskovitz, 580 Egret Dr. #322, Hallandale, FL (US) 33009; Cynthia Watson, 3401 SW. 52nd St., Fort Lauderdale, FL (US) 33312

( * ) Notice: Subject to any disclaimer, the term of this patent is extended or adjusted under 35 U.S.C. 154(b) by 0 days.

(21) Appl. No.: 10/293,089

(22) Filed: Nov. 13, 2002

(65) Prior Publication Data

US 2004/0089680 A1 May 13, 2004

(51) Int. Cl.[7] ..... D06C 15/00
(52) U.S. Cl. ..... 223/84
(58) Field of Search ..... 223/84, 66

(56) References Cited

U.S. PATENT DOCUMENTS 3,190,435 A 6/1965 Schlanger
3,837,476 A 9/1974 Schwartz
5,012,531 A 5/1991 Schoonover
5,556,013 A 9/1996 Mayer

*Primary Examiner*—John J. Calvert
*Assistant Examiner*—James G Smith

(57) ABSTRACT

A receptacle for protectively storing an article of clothing such as one or more brassieres including a lower housing member, an upper housing member, and a pair of brassiere cup support members connected to the lower housing member. In its preferred form, the brassiere cup support members are rotatable relative to the lower housing member so that non-concentrically positioned domed-shaped brassiere cup contacting surfaces connected thereto can be moved toward and away from each other to correspond to the natural distance between the cups of the brassiere(s). The upper housing member defines a planar surface upon which additional garment storage receptacles or other articles can be placed.

16 Claims, 7 Drawing Sheets

GARMENT STORAGE RECEPTACLE

BACKGROUND OF THE INVENTION

1. Field of the Invention

This invention relates generally to storage devices. More particularly, the invention relates to devices which store and protect clothing garments in a state which conforms to the shape of the garment as-worn and, hence, simulates the condition of the garment when it is worn by the wearer.

2. Background Art

The problems associated with maintaining the structural integrity of clothing garments during storage and/or travel are well known. The useful life of a garment can be extended if the garment is not subjected to undo wrinkling, crushing and rubbing against other garments and articles.

Ordinarily, when either storing a clothing article in a drawer or on a shelf, or in a suitcase for travel, the garment is simply placed, or in some cases forcibly shoved, into its storage position where it is in contact with other articles of clothing and the like. Furthermore, it is typically not oriented in its as-worn shape. As a result, the garment becomes prematurely aged.

Likewise, in the display of clothing articles for sale, it is desirable to position the articles in such a way that they can be viewed in the shape which they are in when worn, yet protected from being damaged or otherwise affected by shoppers handling them.

Various attempts have been made in the past to address these issues. One example is found in U.S. Pat. No. 5,556,013 to Mayer, which discloses an intimate garment protector for protecting a bra during laundering. The device is comprised of first and second cup-shaped basket members adapted to receive the cup portions of a bra. The bra is sandwiched between the first and second basket members in the washing process to protect the shape and contour of the bra.

Another example of a device for protecting the shape of an item of wearing apparel is found in U.S. Pat. No. 5,012,531 to Schoonover. Schoonover discloses a form retaining holder for a visored cap. The holder has an upper shell and a lower shell which fit together in a nested configuration and serve to maintain the shape of the cap.

Another attempt to address the foregoing appears in U.S. Pat. No. 3,837,476 to Schwartz, in which is disclosed a brassier display package formed from two transparent sheet members that are secured together with the bra disposed there between. The sheets have nested cup portions integrally formed therein to hold the bra cups. The nested cup portions are formed so as to be slightly outwardly distended to simulate the appearance of the bar when it is worn. Schwartz, however, does not permit storage of a plurality of different sized bra cups, nor does it permit storage of a plurality of bras at one time.

U.S. Pat. No. 3,190,435 to Schlanger discloses a garment retainer package for packaging, shipping, display and storing bras. Schlanger utilizes nested transparent cups. However, the device of Schlanger is designed to retain the bra in a single cup, with the bra folded in half and the straps folded within one of the cups. Moreover, while the package does purport to illustrate shape of one breast cup and thus serves to accurately display one cup, the package still does not give a true and accurate representation of how the brassiere will look in its actually worn condition. In other words, the package does not support the brassier with the brassiere cups in laterally spaced and tensioned relation to each other. Also, the construction of the Schlanger device requires that one of the bra cups be capable of being inverted so as to be disposed in nested relation with respect to the other one of said bra cups prior to the closing of the package.

None of the prior art known to the applicants herein disclose a storage container for protecting articles of clothing, and in particular brasiers, in an as-worn condition and shape, permitting a variety of different sized brassieres to be stored simultaneously or singularly.

SUMMARY OF THE INVENTION

The invention is directed to a receptacle or retainer/holder for articles of clothing which retains those articles of clothing in an as-worn shape and which protects those articles of clothing from undesired and premature wear and tear. The invention, for example but not by way of limitation, is particularly suitable for use in connection with brassiers.

A particular form of the invention illustrated herein includes a brassiere storage receptacle comprised of upper and lower housing halves, which may or may not be hinged together, and one or more pairs of convex bra cup receiving supports adapted to be rotatably received by the housing lower half. The upper and lower housing halves, along with the supports, form an interior space for storing brassiers.

In a second embodiment of the invention, the cup receiving supports are inverted such that the outer surface of the brassiere cups contact interior surfaces of the cup receiving supports with the upper housing half being closeable about the lower housing half so as to enclose the stored brassier within an interior space defined by the upper and lower housing halves. The upper housing half preferably forms a flat surface which permits the stacking of two or more brassiere receptacles one on top of the other.

The housing halves are preferably constructed of vacuum formed material such as thin gauge sheet-like plastic which is preferably clear to facilitate viewing of the garments therein, but also may be made of opaque materials, including cardboard or any other material which will occur to those of skill in the art.

In a third embodiment of the invention, the receptacle is formed of semi-rigid neoprene, reenforced neoprene, or other suitably semi-flexible covering material out of which the clothing article receptacle of the invention is formed. In this embodiment, the cup receiving supports are integrally formed with the housing. Consequently, this third embodiment is a one-sized-fits-all version of the invention since the cup supports do not have interchangeable sizes. In one configuration, the third embodiment of the invention is comprised of upper and lower halves which are hinged together by a live hinge, the first and second housing halves being fastenable together by any convenient closure apparatus such as a zipper or hook and loop material. Preferably, the housing of this embodiment defines a large enough volume to fit up to three brassieres therein.

The invention provides a cost effective, simple to manufacture solution for the problem of premature aging of clothing articles.

Accordingly, it is an object of the present invention to provide a clothing storage receptacle which reduces the tendency of stored clothing articles to become permanently worn.

Another object of the invention is to provide a storage receptacle for a brassiere wherein the brassier is dispose in its as-worn shape.

It is also an object of the invention to provide a brassiere storage receptacle which can store one or more brassiers in stacked relation within a single receptacle.

The above brief description, as well as further objects, features and advantages of the present invention, will be more fully appreciated by reference to the following detailed description viewed in connection with the associated drawings.

DETAILED DESCRIPTION OF A PREFERRED OTHER EMBODIMENTS

Figure 1:
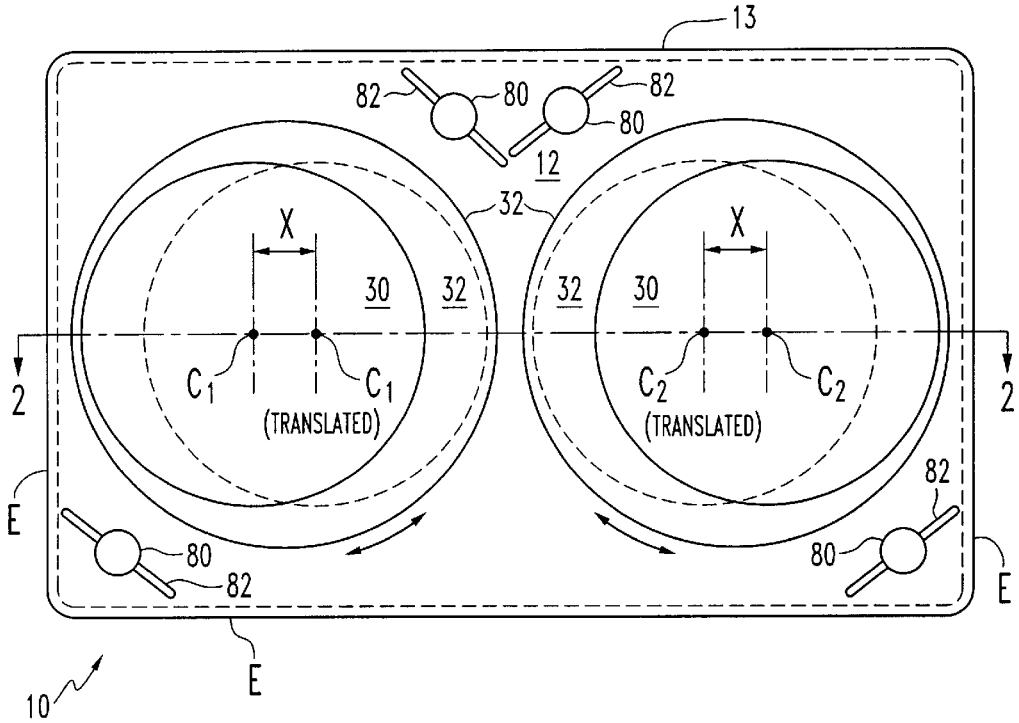
FIG. 1 is a top plan view of the lower housing half and the bra cup-receiving supports rotatbly mounted therein.
Figure 2A:
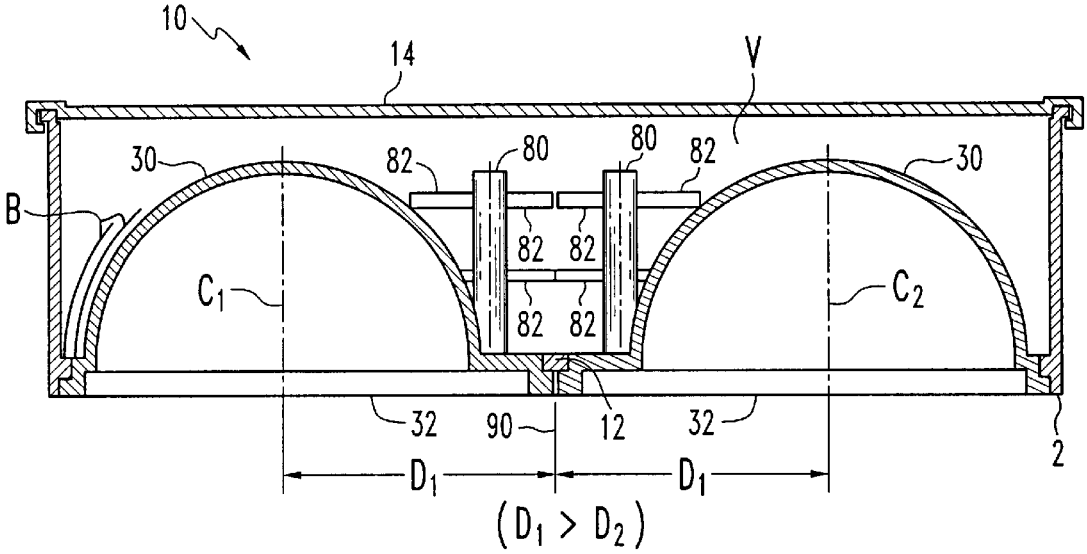
FIGS. 2A and 2B are cross sectional elevational views showing alternative support positions taken along lines 2—2 of FIG. 1.
Figure 2B:
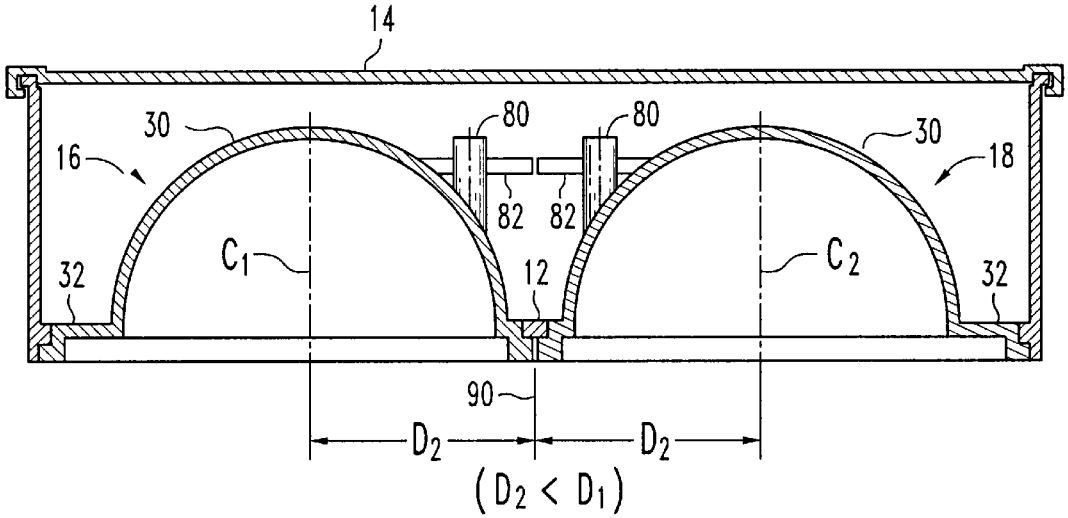
Figure 3:
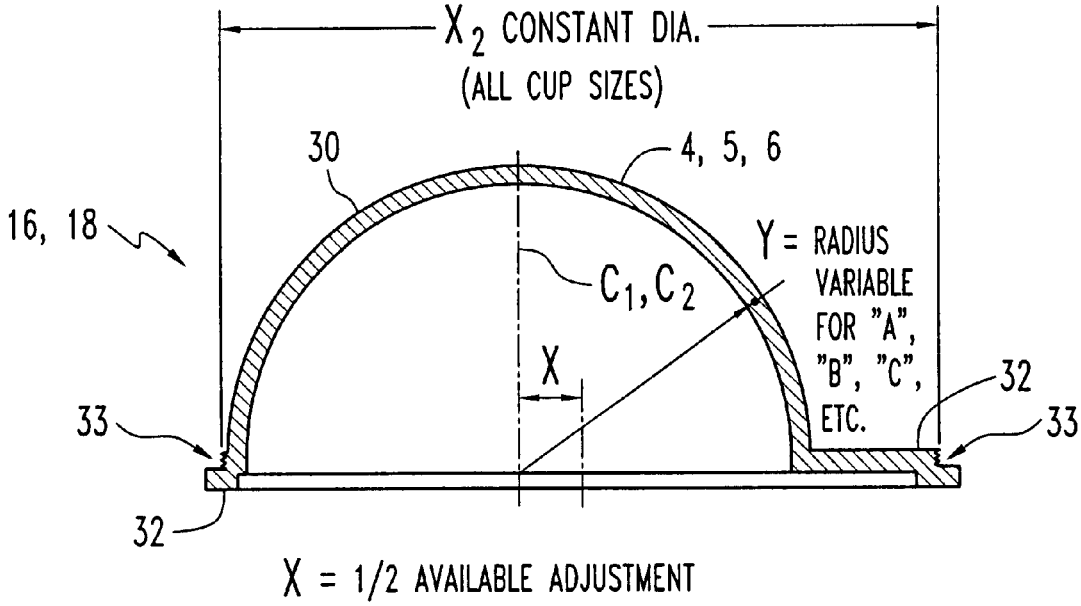
FIG. 3 is a cross sectional elevational view of one bra cup support element.
Figure 4:
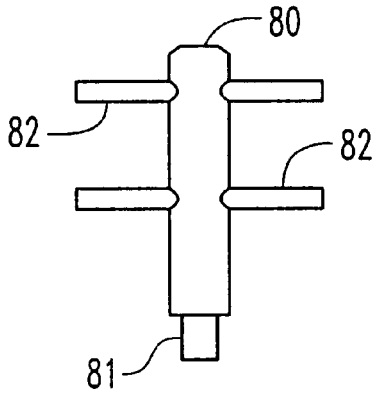
FIG. 4 is a front elevational view of a brassiere strap receiving post for use with the invention.
Figure 5:
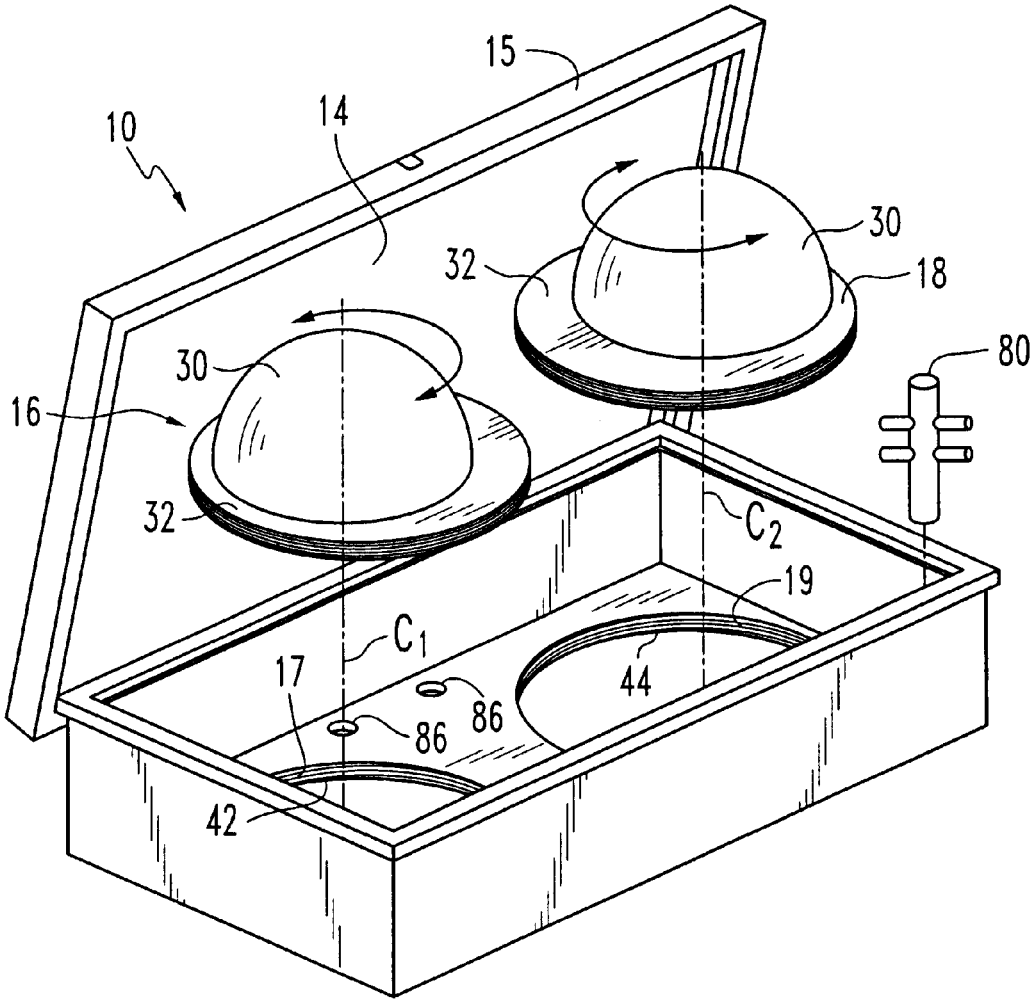
FIG. 5 is a perspective exploded view of the invention.

Referring now to the drawings, a first embodiment of the garment storage receptacle 10 shown in FIGS. 1–5 is comprised of a lower housing half or garment support deck 12 hingedly connected to a top or cover 14 via hinge 15, which may be a living hinge or any other structure which will permit top 14 to move reciprocally about a rear edge 13 of lower housing half 12 between an open position shown in FIG. 5 and a closed position shown in FIGS. 2A and 2B. Alternatively, top and bottom housing portions 12 and 14 may be releasably coupleable without being hinged. A pair of left and right brassiere cup support elements 16, 18 are employed. Supports 16, 18 are received within corresponding cup support receiving openings 17, 19 defined by deck 12.

In the preferred embodiment, support elements 16, 18 are rotatable with respect to deck 12. Elements 16, 18, one of which is shown in FIG. 3, are each comprised of a domed member 30 sized and shaped to simulate the shape of a brassiere cup, connected to a disc shaped base 32. Base 32 is circularly shaped as shown in FIGS. 1 and 5. Members 30 of support elements 16 and 18 are rigidly and/or integrally connected to base members 32 in a non-concentric orientation, such that rotation of bases 32 within corresponding cutouts 17, 19 of deck 12 will cause center lines $C_1$ and $C_2$ to move relative to each other, as can be seen through a comparison of FIGS. 2A and 2B. In this way, a brassiere positioned with its cups laid atop members 30 can be oriented in the most desired shape by spacing center lines $C_1$ and $C_2$ apart from each other by a distance which corresponds to the spacing of the cups of the brassiere (not shown).

Bases 32 are preferably provided with a constant diameter $X_2$, but the radius Y will be different to correspond to each of the different cup sizes "A", "B", "C", "D", etc. It is to be understood that the contour of members 30 may be other than spherical. The shape chosen will function suitably so long as it is rounded.

Top 14 defines a lower flared flange 15 which is adapted to nest in interfitting engagement with a peripheral edge E of deck 12. The interfitting connection therebetween may be a snap fit, interference fit, or any suitable closure arrangement which will permit a user to maintain the device 10 in its closed orientation shown in FIGS. 2A and 2B. When in its closed position as shown, lid 14, deck 12 and supports 30 define an interior volume V in which the clothing article, e.g. brassiere, is stored.

Cut outs 17, 19 define corresponding annular grooves 42, 44 in which corresponding shoulders 46, 48 of base 32 fit. The base 32 may either be threadingly connected to deck 12 or may be connected (preferably removably so as to permit interchanging of different cup size support members) via a lip (not shown) or other retention structure.

Support posts 80 with corresponding transverse support prongs 82 permit the organized placement of clothing articles within volume V. Posts 80 may, as shown in FIG. 4, utilize a dowel-like connector 81 adapted to fit into corresponding apertures 86 defined by deck 12. For example, posts 80 and support arms 82 may be used to drape bra straps thereover so that the brassiere can be maintained in a wrinkle-free condition within device 10.

As shown in FIG. 3, each center line $C_1$ and $C_2$ can be translated by rotation of support members 16, 18 by a distance $D_1$ minus $D_2$ by rotating members 16 and 18 through an arc of 180°, which is designed with respect to the invention to be suitable for accommodating essentially all brassier constructions. In so doing, supports 16 and 18 can be moved toward and away from each other by the distance 2 $(D_1–D_2)$.

Rotating supports 16 and 18 any amount less than 180° will cause the spacing between centerlines $C_1$ and $C_2$ to be increased or decreased less than the maximum distances of 2 $(D_1–D_2)$ Support members 16, 18 may come in a variety of different sizes to correspond to "A", "B", "C", "D", etc, brassiere cup sizes. Device 10 may be provided as a kit containing a variety of interchangeable differently sized support elements 16, 18 in which the radius of curvature Y corresponds to the particular bra cup size "A", "B", "C", etc.

Lid 14 forms a generally planar surface upon which additional devices 10 or other items may be stacked.

Figure 6:
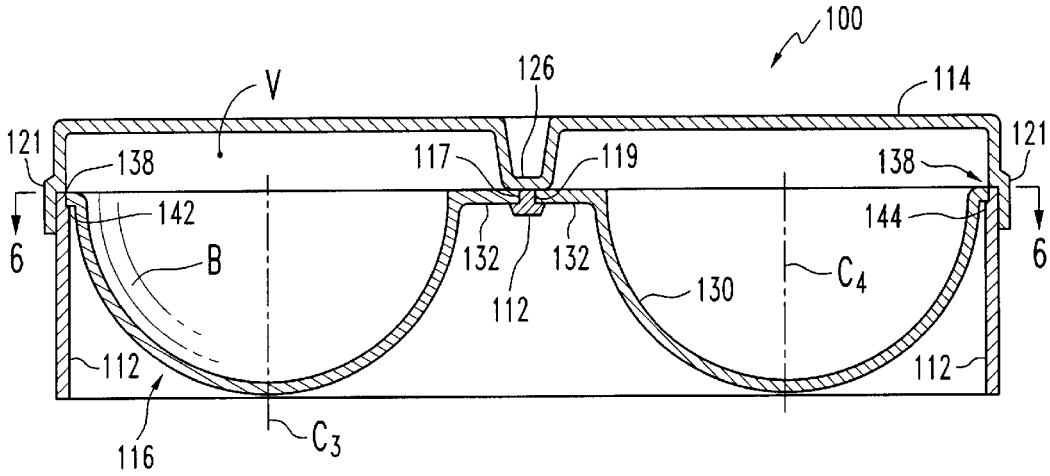
FIG. 6 is a cross sectional elevational view of a first alternative embodiment of the invention.
Figure 7:
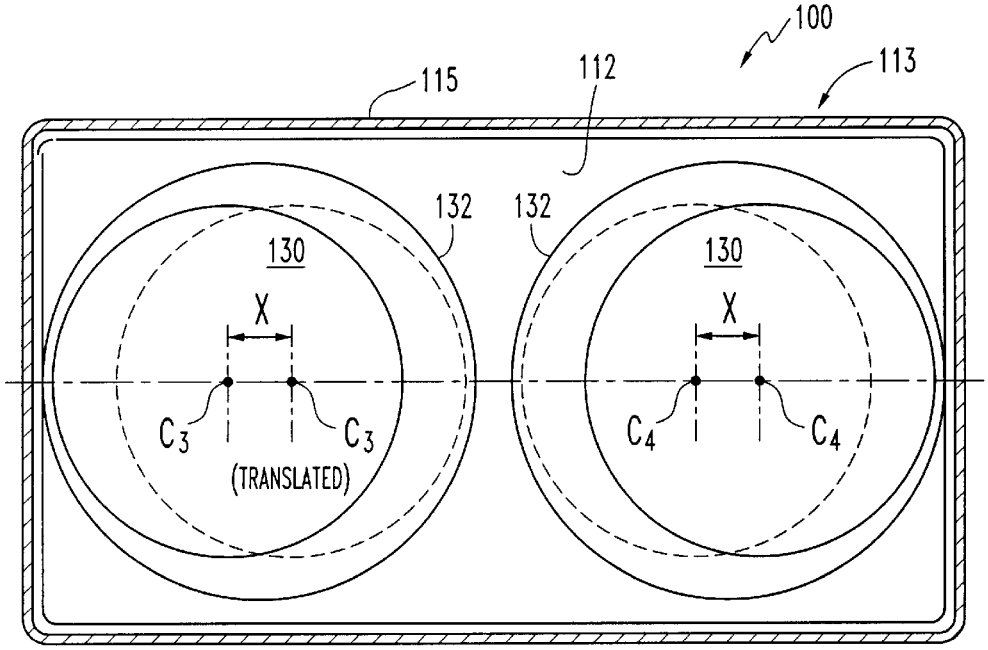
FIG. 7 is a top plan view of the alternative embodiment showing the lower housing half and brassiere cup-receiving supports rotatably mounted therein.
Figure 8:
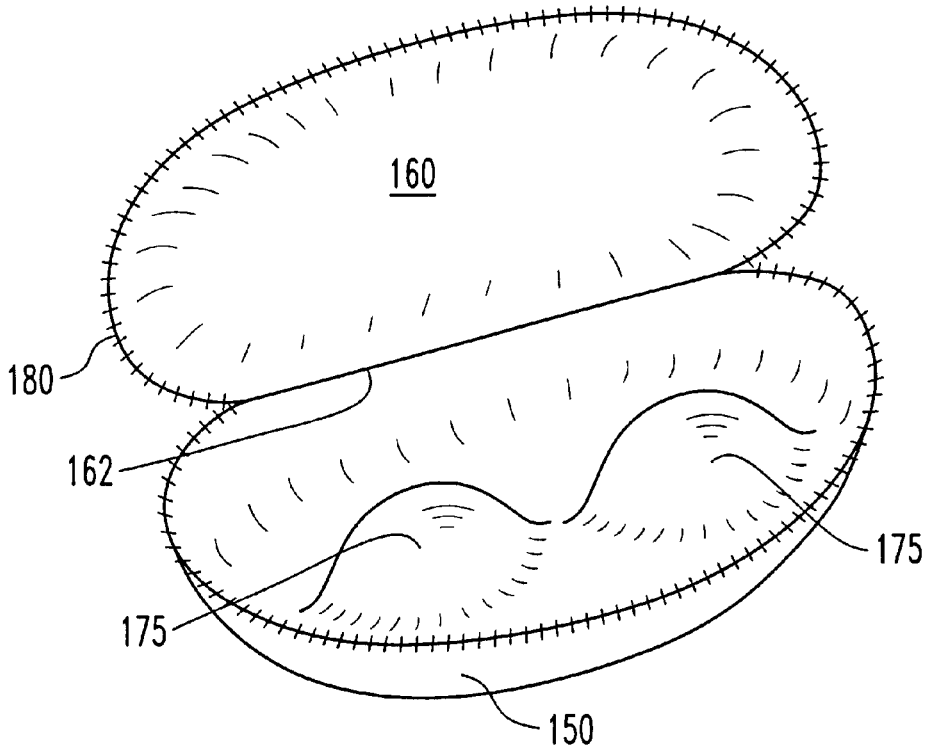
FIG. 8 is a perspective view of the a second alternative embodiment of the invention.

A second embodiment of the invention is shown in FIGS. 6, 7 and 8 wherein a garment storage receptacle 100 is shown, comprised of a base or deck 112 to which is hingedly attached a top or lid 115 along a rear edge 113, and a pair of brassiere cup support elements or members 116, 118 rotatably-adjustably connected to deck 112. In this embodiment, the brassiere is placed in face-down manner against interior surfaces of domed support members 130 of support elements 116, 118. The outward facing surfaces of brassiere cup B contact the interior surface of elements 130. One or more brassieres can be stored in this fashion.

Support members 116, 118 are rotatably received within corresponding cut outs 117, 119, respectively. Rotation of members 116, 118 within cutouts 117, 119 cause the center lines $C_3$, $C_4$ thereof to move toward and away from each other as described in connection with FIGS. 1 through 5.

A centrally disposed concave depression 126 may be employed in connection with lid 114 to lend to the structural rigidity of the overall device 100. Preferably, depression 126 contacts deck segment 112 as well as the bottoms of bases 132 of support members 116, 118. Obvious modifications to or variation on this rigidyfying structure are contemplated to be within the scope of the invention.

Flange 121 of lid 114 is adapted to fit over edge 138 of deck 112 and remain detachably secured thereabout as discussed in connection with FIGS. 1–5.

Figure 9:
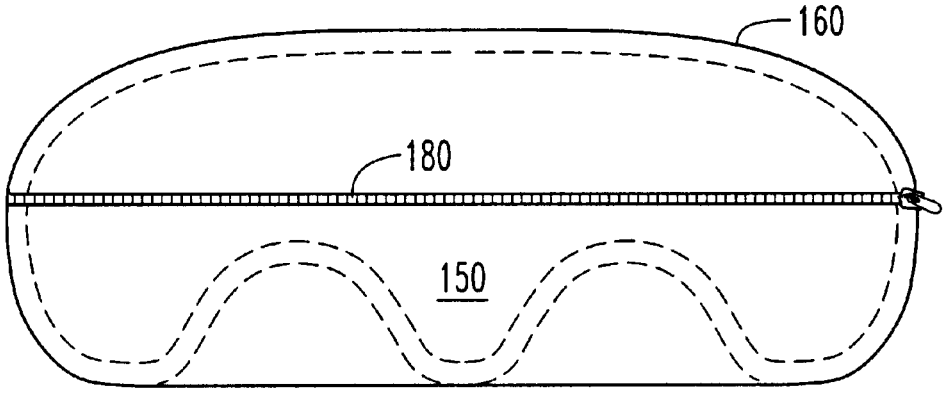
FIG.9 is a front elevational view of the second embodiment of the invention.
Figure 10:
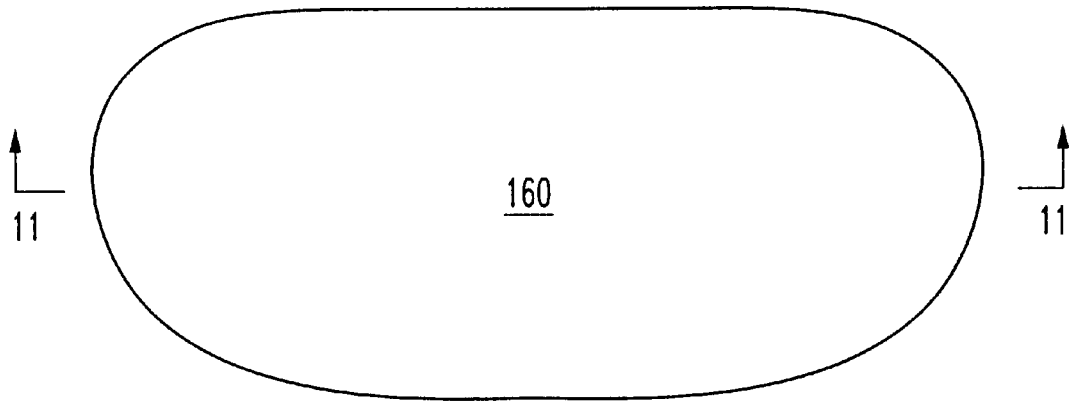
FIG. 10 is a top plan view of the second embodiment of the invention.
Figure 11:
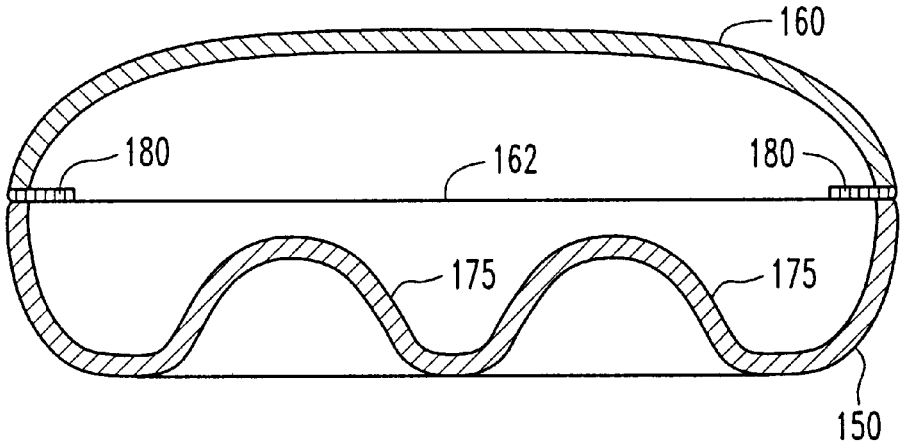
FIG. 11 is a cross sectional front elevational view of the second embodiment of the invention taken along lines 11—11 of FIG. 10.

FIGS. 8 and 9 show a second alternative embodiment of the invention. Comprising a base members 150 hingedly connected to a lid 160 via a live hinge 162. base 150 and lid 160 in this embodiment are manufactured of a resilient, semi rigid material such as a neoprene based composite similar to that used in the overnight kits provided by most major airlines on international flights.

Base 150 defines a pair of supports 175 which function in the manner of supports 30 shown in FIGS. 1–5 but with the exception that they are fixed to base 150. A closure such as zipper 180 may be employed to attach lid 160 to base 150 when the device is closed. In this way, garments stored therein are protected during travel. This embodiment provides a light weight, yet durably garment storage receptacle in accordance with this invention.

A third embodiment of the invention is shown in FIG. 9. In this embodiment, the device is essentially a one piece semi-resilient, semi-rigid housing. A pair of lower and upper hingedly connected halves 214, 212, the lower half 212 defining a pair of brassiere cup supports 216, 218 adapted to support one or more brassieres (not shown). The housing 210 of this embodiment is preferably manufactured of a neoprene or other soft coating over or impregnated with a substrate material to retain the device. However, the device of this embodiment is ideally suitable as a travel receptacle for clothing articles such as brassieres, and as such should be light weight and somewhat flexible to facilitate fitting within a fully packed suitcase, garment bag, overnight bag, etc.

A closure mechanism such as zipper 220 maybe employed to retain lower and upper housing halves 214, 212 in releseably connection with each other when the device is closed. Other closure structures such as hook and loop fasteners, snaps, etc, are contemplated to be within the scope of the invention.

Various modifications and alterations of this invention will become apparent to those skilled in the art without departing from the scope and spirit of this invention, and it is understood that this invention is not limited to the illustrative embodiments set forth hereinbefore.

What is claimed is:

1. A garment storage receptacle comprising:

a lower housing member defining a pair of cutouts therein; an upper housing member adapted to be placed in detachably secured engagement to the lower housing member;

a pair of removable brassiere cup support members adapted to be removably connected within the pair of cutouts in the lower housing member.

2. The receptacle of claim 1, wherein the support members are rotatable with respect to the lower housing member.

3. The receptacle of claim 1, wherein the top housing member is hingedly connected to the lower housing member along corresponding edges thereof.

4. The receptacle of claim 2, wherein the brassiere cup support members each include a generally domed brassiere cup contacting element and a base element, said base element and said brassiere cup contacting element defining non-concentric circular peripheries.

5. The receptacle of claim 1, further comprising at least one brassiere strap support connected to the lower housing member.

6. The receptacle of claim 1, wherein the support members form convex raised projections extending from the lower housing member toward the upper housing member.

7. The receptacle of claim 1, wherein the support members form concave depressed projections extending from the lower housing member away from the upper housing member.

8. A receptacle for protectively storing one or more brassieres, comprising:

a lower housing member defining a pair of circular cutouts therein; an upper housing member hingedly attached to the lower housing member and adapted to be moved between an open position and a closed position with respect to the lower housing member;

a pair of brassiere cup support members rotatably connected within said cutouts; set support members including non-concentrically mounted brassiere cup receiving surfaces which are movable toward and away from each other by rotation of the support members with respect to the lower housing member.

9. The receptacle of claim 8, wherein the top housing member is hingedly connected to the lower housing member along corresponding edges thereof.

10. The receptacle of claim 8, further comprising at least one brassiere strap support connected to the lower housing member.

11. The receptacle of claim 8, wherein the support members form convex raised projections extending from the lower housing member toward the upper housing member.

12. The receptacle of claim 8, wherein the support members form concave depressed projections extending from the lower housing member away from the upper housing member.

13. A method for protectively storing one or more clothing articles utilizing a garment storage receptacle comprising a lower housing member defining a pair of cutouts therein; an upper housing member adapted to be placed in detachably secured engagement to the lower housing member; a pair of removable brassiere cup support members adapted to be removably connected within the pair of cutouts in the lower housing member, wherein the support members are rotatable with respect to the lower housing member, said method comprising the steps of:

providing at least one brassiere having brassiere cups spaced apart by a predetermined distance to be stored;

placing the at least one brassiere in the receptacle in such a way that the brassiere cups at least partially cover the support members;

rotating the support members relative to the lower housing member so that the support members are spaced by a distance corresponding to the predetermined distance by which the bra cups are spaced.

14. A method for protectively storing one or more clothing articles utilizing a receptacle for protectively storing one or more brassieres, comprising: a lower housing member defining a pair of circular cutouts therein; an upper housing member hingedly attached to the lower housing member and adapted to be moved between an open position and a closed position with respect to the lower housing member; a pair of brassiere cup support members rotatably connected within said cutouts; set support members including non-concentrically mounted brassiere cup receiving surfaces which are movable toward and away from each other by rotation of the support members with respect to the lower housing member, said method comprising the steps of:

providing at least one brassiere having brassiere cups spaced apart by a predetermined distance to be stored;

placing the at least one brassiere in the receptacle in such a way that the brassiere cups at least partially cover the support members;

rotating the support members relative to the lower housing member so that the support members are spaced by a distance corresponding to the predetermined distance by which the bra cups are spaced.

15. A method for protectively storing one or more clothing articles utilizing a garment storage receptacle comprising a lower housing member defining a pair of cutouts therein; an upper housing member adapted to be placed in detachably secured engagement to the lower housing member; a pair of removable brassiere cup support members adapted to be removably connected within the pair of cutouts in the lower housing member, wherein the support members are rotatable with respect to the lower housing member, said method comprising the steps of:

providing at least one brassiere having brassiere cups spaced apart by a predetermined distance to be stored;

rotating the support members relative to the lower housing member so that the support members are spaced by a distance corresponding to the predetermined distance by which the bra cups are spaced;

placing the at least one brassiere in the receptacle in such a way that the brassiere cups at least partially cover the support members.

16. A method for protectively storing one or more clothing articles utilizing a receptacle for protectively storing one or more brassieres, comprising: a lower housing member defining a pair of circular cutouts therein; an upper housing member hingedly attached to the lower housing member and adapted to be moved between an open position and a closed position with respect to the lower housing member; a pair of brassiere cup support members rotatably connected within said cutouts; set support members including non-concentrically mounted brassiere cup receiving surfaces which are movable toward and away from each other by rotation of the support members with respect to the lower housing member, said method comprising the steps of:

providing at least one brassiere having brassiere cups spaced apart by a predetermined distance to be stored;

rotating the support members relative to the lower housing member so that the support members are spaced by a distance corresponding to the predetermined distance by which the bra cups are spaced;

placing the at least one brassiere in the receptacle in such a way that the brassiere cups at least partially cover the support members.

* * * * *